US010322444B2

(12) United States Patent
Moore et al.

(10) Patent No.: US 10,322,444 B2
(45) Date of Patent: Jun. 18, 2019

(54) APPARATUS, SYSTEM, AND METHOD FOR MANIPULATION OF NESTED STAMPED PARTS

(71) Applicant: Honda Motor Co., Ltd., Tokyo (JP)

(72) Inventors: William R. Moore, Barrie (CA); Emily Germann, Barrie (CA); Paul Adams Thompson, Lisle (CA); John Scott McQueen, Marysville, OH (US); Jeffrey Frank Teubl, Worthington, OH (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 15/408,050

(22) Filed: Jan. 17, 2017

(65) Prior Publication Data

US 2018/0201451 A1 Jul. 19, 2018

(51) Int. Cl.
*B23Q 1/52* (2006.01)
*B23Q 1/25* (2006.01)
(Continued)

(52) U.S. Cl.
CPC ..... *B21D 43/105* (2013.01)

(58) Field of Classification Search
CPC .... B65G 47/248; B65G 47/24; B65G 47/244; B65G 17/48; B65G 49/0459;
(Continued)

(56) References Cited

U.S. PATENT DOCUMENTS 2,921,702 A * 1/1960 Gross ..... B65B 23/02 414/416.09
4,056,198 A 11/1977 Boserup
(Continued)

FOREIGN PATENT DOCUMENTS

EP 1842605 A2 10/2007
EP 2441533 A1 4/2012
(Continued)

OTHER PUBLICATIONS

Hedrick, Art, "Part nesting and die design tips for reducing and utilizing scrap in stamping operations," http://www.thefabricator.com/article/stamping/part-nesting-and-die-design-tips-for-reducing-and-utilizing-scrap-in-stamping-operations (Accessed Oct. 13, 2016), 7 pages.

(Continued)

*Primary Examiner* — Gregory W Adams
(74) *Attorney, Agent, or Firm* — Armstrong Teasdale LLP

(57) ABSTRACT

An apparatus for rotating an inner stamped part with respect to an outer stamped part is provided. The inner stamped part is nested within an aperture formed within the outer stamped part. The apparatus includes a plurality of grippers that include at least a first gripper positioned at a first edge of the inner stamped part and a second gripper positioned at a second edge of the inner stamped part opposite to the first edge. The plurality of grippers is configured to grip the inner stamped part at the first edge and the second edge, respectively. The plurality of grippers is further configured to rotate the gripped inner stamped part about an axis of rotation. The axis of rotation intersects the first gripper and the second gripper. The plurality of grippers is also configured to open to release the inner stamped part.

17 Claims, 13 Drawing Sheets

(51) Int. Cl.
*B62D 65/18* (2006.01)
*B21D 43/10* (2006.01)

(58) Field of Classification Search
CPC .... B21D 5/0281; B21D 43/14; B25J 15/0004; B23Q 1/52; B23Q 7/04; B23Q 7/048; B05C 3/10
USPC ..... 118/320, 416; 164/409; 225/96.5; 228/49.1, 49.2; 414/416.01, 416.09, 422, 414/753.1, 758, 762, 763, 764, 765, 766, 414/767, 771, 772, 773, 775, 783, 785; 72/203, 328, 329, 330, 422
See application file for complete search history.

(56) References Cited

U.S. PATENT DOCUMENTS 4,125,072 A 11/1978 Maier et al.
4,202,403 A * 5/1980 Miller ..... B22C 17/08 164/168
4,353,675 A * 10/1982 Risener ..... B65B 55/24 414/403
4,493,450 A * 1/1985 Yuzui ..... B23K 37/047 198/403
4,494,902 A * 1/1985 Kuppens ..... H01L 21/67 156/541
4,557,135 A * 12/1985 Ragettli ..... B21D 5/0281 72/389.3
4,754,863 A 7/1988 Tsuchiya et al.
4,770,596 A * 9/1988 Sartorio ..... B21D 43/105 414/732
4,921,387 A * 5/1990 Bennington ..... B21D 43/105 198/468.6
5,042,287 A * 8/1991 Sartorio ..... B21D 5/0281 414/431
5,067,303 A * 11/1991 Brookman ..... B65B 69/00 414/412
5,249,686 A * 10/1993 Brookman ..... B65B 69/00 206/499
5,345,806 A * 9/1994 Sartorio ..... B21D 43/026 414/758
5,498,294 A * 3/1996 Matsushita ..... H01L 21/67028 134/18
5,540,536 A * 7/1996 Hoedl ..... B65D 11/18 206/507
5,964,954 A * 10/1999 Matsukawa ..... B08B 1/007 134/18
6,142,725 A * 11/2000 Crorey ..... B23Q 1/52 198/379
6,205,745 B1 * 3/2001 Dudderar ..... H01L 21/67132 221/74
6,874,515 B2 * 4/2005 Ishihara ..... B08B 1/04 134/140
6,918,735 B2 * 7/2005 Urban ..... H01L 21/68707 294/106
7,014,415 B2 * 3/2006 Yoshizawa ..... H01L 21/6734 414/422
7,407,359 B2 * 8/2008 Sisson ..... H01L 21/67333 414/404
7,926,441 B2 * 4/2011 Tsutsumi ..... H01L 21/67051 118/300
9,032,605 B2 5/2015 Keys et al.
2012/0076630 A1 * 3/2012 Tehrani ..... B66F 3/46 414/783
2015/0118003 A1 * 4/2015 Bacalia ..... B25J 9/1682 414/771

FOREIGN PATENT DOCUMENTS

FR 3008634 A1 1/2015
FR 3028782 A1 5/2016
GB 1604291 A 12/1981
JP S5820334 A 2/1983
JP S58128231 A 7/1983
JP 2004025253 A 1/2004

OTHER PUBLICATIONS

Japanese First Office Action, Application No. 2018-4829, dated Feb. 12, 2019, and unofficial English translation thereof 11 pps.

* cited by examiner

APPARATUS, SYSTEM, AND METHOD FOR MANIPULATION OF NESTED STAMPED PARTS

BACKGROUND

The present disclosure relates generally to devices and methods for stamping multiple parts from a single metal blank and, more specifically, for rotating at least one part relative to at least one of multiple nested parts stamped from a single metal blank as part of a manufacturing process.

To enhance the efficiency of energy and material utilization associated with part production, some sheet metal stamping processes may produce two or more different parts using a single press stroke. The resulting parts produced may be nested together within a single sheet of sheet metal feedstock upon completion of the single press stroke. Although these multi-part sheet metal stamping processes may enhance process efficiency, the post-stamping processes associated with each individual nested part may differ from one another. However, at least some known multi-part metal stamping processes do not provide for individualized post-stamping processes for each of the multiple nested parts, such as rotating one nested part differently relative to the other parts. As a result, damage-prone regions of one or more of the multiple nested parts, such as projecting legs or tabs, may be vulnerable to damage during post-stamping processes such as conveyor transport or sorting.

BRIEF SUMMARY

In one aspect, an apparatus for rotating an inner stamped part with respect to an outer stamped part is provided, in which the inner stamped part is nested within an aperture formed within the outer stamped part. The apparatus includes a plurality of grippers that includes at least a first gripper positioned at a first edge of the inner stamped part and a second gripper positioned at a second edge of the inner stamped part opposite to the first edge. The plurality of grippers is configured to grip the inner stamped part at the first edge and the second edge, respectively. The plurality of grippers is further configured to rotate the gripped inner stamped part about an axis of rotation. The axis of rotation intersects the first gripper and the second gripper. The plurality of grippers is also configured to open to release the inner stamped part.

In another aspect, a system for rotating an inner stamped part with respect to an outer stamped part is provided, in which the inner stamped part is nested within an aperture formed within the outer stamped part. The system includes a plurality of grippers. The plurality of grippers includes at least a first gripper positioned at a first edge of the inner stamped part, and a second gripper positioned at a second edge of the inner stamped part opposite to the first edge. The system further includes a base affixed to the plurality of grippers and further affixed to a station of a press line.

In another additional aspect, a method for rotating an inner stamped part with respect to an outer stamped part is provided in which the inner stamped part is nested within an aperture formed within the outer stamped part. The method includes receiving the inner stamped part onto a lifter in a raised position, at least a first gripper in an opened position, and a second gripper in the opened position. The method also includes closing the first and second grippers to grip the inner stamped part, lowering the lifter away from the gripped inner stamped part, and rotating the inner stamped part about an axis of rotation intersecting the first gripper and the second gripper. The method further includes raising the lifter up to the rotated inner stamped part and opening the first and second grippers to release the rotated inner stamped part.

DETAILED DESCRIPTION

The apparatus, systems and methods described herein relate generally to the manufacturing processes of stamped metal parts, and more specifically, to production and post-production handling of stamped metal parts fabricated using a part-in-part (PIP) manufacturing process, in which one or more inner stamped parts nested within an aperture formed within an outer stamped part are formed using a single press stroke. In various aspects, the PIP process may enhance the efficiency of utilizing materials, such as metal stock, by producing one or more additional parts from material that would typically be discarded or reused after completion of the pressing of a single part. Further, because two or more parts are formed in a single press stroke, the PIP manufacturing process may further enhance energy efficiency and production time relative to other manufacturing processes that may use separate press strokes, separate dies, and/or separate presses to produce individual presses parts.

Figure 1:
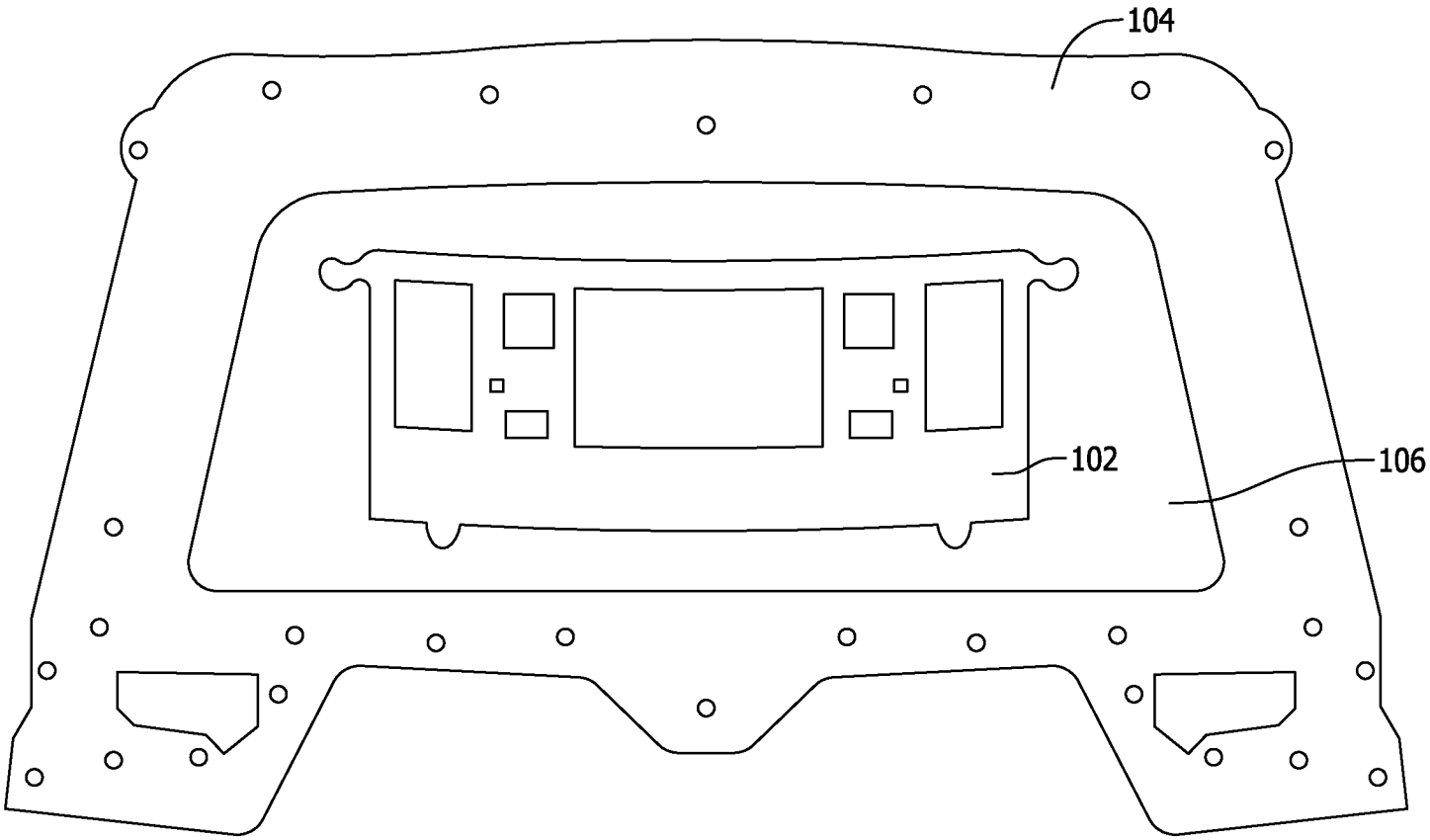
FIG. 1 is a top view of an exemplary inner stamped part nested within an outer stamped part.

FIG. 1 is a top view showing an inner stamped part 102 nested within an aperture 106 formed within an outer stamped part. In various aspects, PIP production method produces at least one inner stamped part 102 positioned within the aperture 106 by providing additional die features to form the metal stock positioned within the aperture 106. Typically, in known processes, said metal stock may be trimmed and removed using non-PIP production methods, into one or more additional inner stamped parts 102. However, additional post-production processes may be needed to manipulate one or more of the multiple nested parts.

Figure 2:
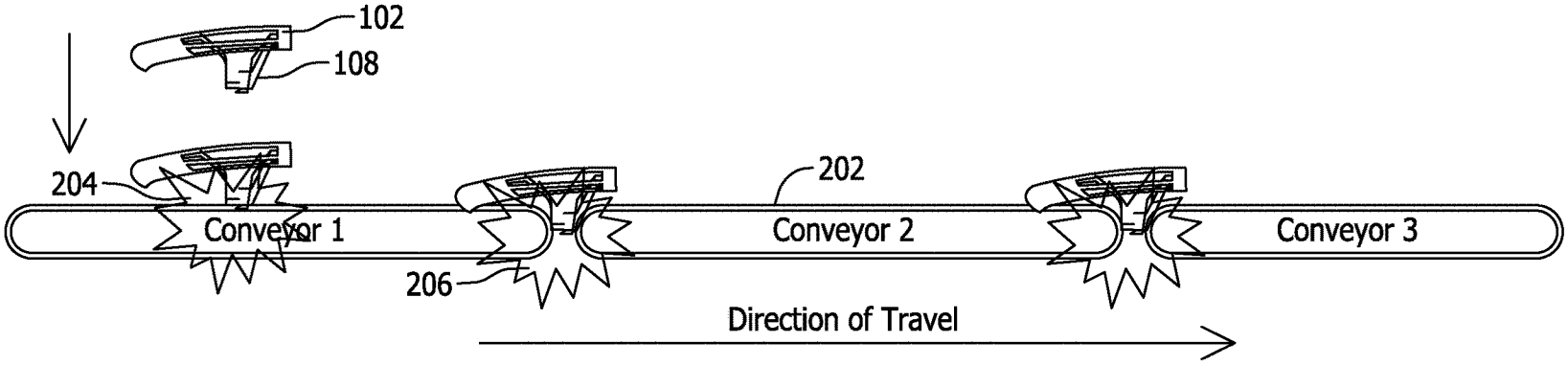
FIG. 2 is a schematic illustration showing potential exemplary post-production related damage risks to inner stamped parts.

A PIP manufacturing process including, but not limited to the inner stamped parts 102 and outer stamped parts 104 may produce an inner stamped part 102 that may include tabs, legs, or other deformable projections in which the deformable projections may be positioned in an orientation that may result in an increased risk of damage to the deformable projections during post-production processes. FIG. 2 is a schematic side view of inner part 102 with deformable legs 108 progressing through post-production handling processes. As illustrated in FIG. 2, if legs 108 are oriented downward, the legs 108 may be vulnerable to damage after an impact 204 of the dropped part 102 on a conveyer 202. In addition, the legs 108 may get caught within irregularities in the surface of the conveyor 202 such as gaps 206, further exposing the legs 108 to possible damage.

Figure 3:
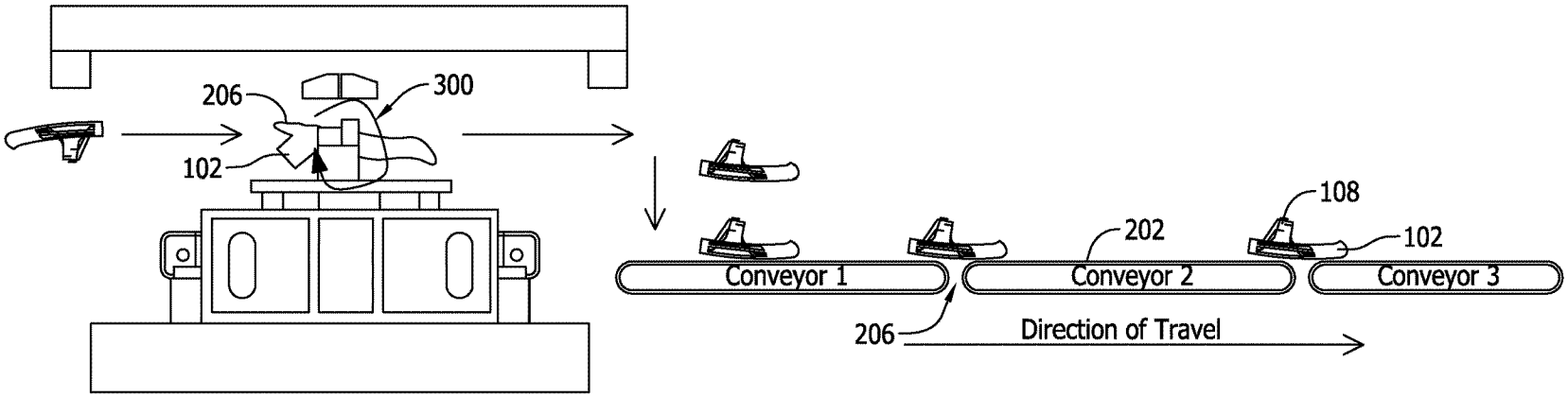
FIG. 3 is a schematic illustration of an exemplary apparatus for the selective rotation of an inner stamped part.

FIG. 3 is a schematic overview of an apparatus 300 for the rotation 302 of an inner stamped part 102 in a PIP manufacturing process. As illustrated in FIG. 3, the inner stamped part 102 may be selectively inverted relative to the outer stamped part 104 (not shown) prior to post-production processes, such as transport on a conveyer belt 202. By inverting the inner stamped part 102, the legs 108 of the part 102 may project upward and away from potentially damaging equipment features such as gaps 206 within the conveyor belt 202.

Figure 4:
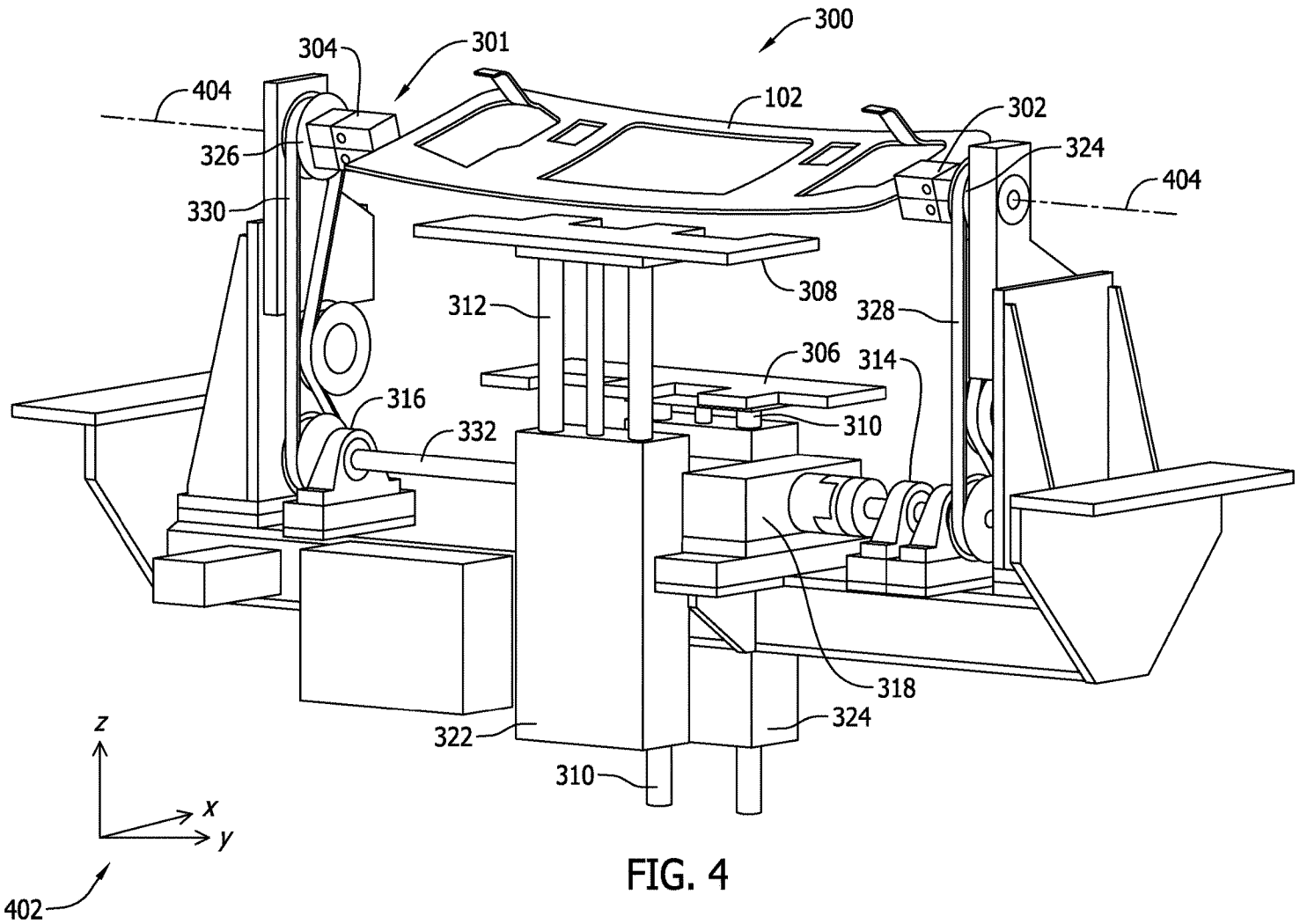
FIG. 4 is a perspective view of an exemplary apparatus for use in rotating an inner stamped part relative to an outer stamped part.

In various aspects, the rotation of the inner stamped part 102 relative to the outer stamped part 104 may be enabled by an apparatus 300, shown illustrated in FIG. 4. Although the description of the apparatus 300, system, and method of rotating the inner stamped part 102 disclosed herein below is presented in the context of a single rotation or flip of the inner stamped part 102, it is to be understood that the apparatus 300 may enable any combination of translations and/or rotations without limitation. In particular, the apparatus 300 may enable any amount of rotation as needed to enhance an aspect of the post-production handling including, but not limited to, dropping or otherwise transferring the inner stamped part 102 from the apparatus 300 to a conveyor belt or other part sorting or transport device. In one non-limiting example, the inner stamped part 102 may be rotated about 180° (i.e. flip the inner stamped part) relative to the outer stamped part 104.

In another aspect, the inner stamped part 102 may be rotated about any axis of rotation without limitation using the apparatus 300. In one aspect, the inner stamped part 102 may be rotated about an axis of rotation 404 that is parallel with one of the coordinate axes of the coordinate system 402 as defined in FIG. 4 including, but not limited to an x-axis defined parallel to the direction of movement of the pressed parts from station to station within the press line used to produce the inner pressed part 102 and outer pressed part 104, a y-axis defined perpendicular to the direction of movement of the pressed parts as well as within a horizontal plane parallel to the plane of the sheet metal feedstock within the press line prior to exposure to any of the press cycles, and a z-axis defined in an upward direction that is also mutually perpendicular to the x-axis and the y-axis. By way of non-limiting example, the axis of rotation 402 may be oriented parallel to the y-axis of coordinate system 402, as illustrated in FIG. 4. In other aspects, the axis of rotation 404 may be oriented at any arbitrary direction within the coordinate system 402 as defined in FIG. 4.

In an additional aspect, the inner stamped part 102 may be rotated two or more times about two or more different axes of rotation 404 without limitation. In one aspect, each rotation of the two or more rotations of the inner stamped part 102 may be enabled by a single pair of grippers similar to the pair of grippers 301 illustrated in FIG. 4. By way of non-limiting example (not illustrated) the support platform on which a single pair of grippers is mounted may itself be mounted to a turntable or other means of enabling a rotation of the inner stamped part 102 about a second axis of rotation. In another aspect, the two or more rotations of the inner stamped part 102 may be enabled by a first pair of grippers corresponding to the rotation about a first axis of rotation, a second pair of grippers corresponding to the rotation about a second axis of rotation, and so on. By way of non-limiting example (not illustrated) the apparatus 300 may incorporate an additional pair of grippers (not shown) aligned with a second axis of rotation in addition to the first pair of grippers 301 aligned with the first axis of rotation 404 as illustrated in FIG. 4. In this other aspect, each rotation of the inner stamped part 102 may be enabled sequentially by successive pairs of grippers that each grip the inner stamped part 102 one at a time in series.

Referring again to FIG. 4, the apparatus 300 may include at least one pair of grippers 301 configured to enable several aspects of the method of rotating the inner stamped part relative to the outer stamped part as disclosed herein. In one aspect, the pair of grippers 301 may be configured to receive an inner stamped part 102 from a preceding station of a press line used to produce the nested inner and outer stamped parts produced using a PIP manufacturing process. In another aspect, the pair of grippers 301 may be configured to grasp and rotate the inner stamped part 102 about an axis of rotation 404. In another additional aspect, the pair of grippers 301 may be configured to release the rotated inner stamped part 102 prior to transfer to a subsequent station of a press line.

Figure 5B:
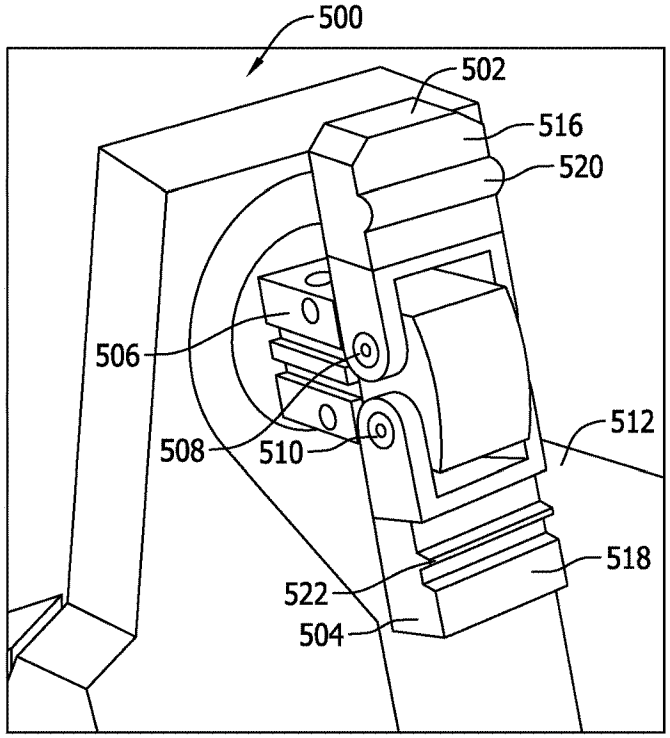
FIG. 5B is the gripper shown in FIG. 5A, and in an opened position.
Figure 5A:
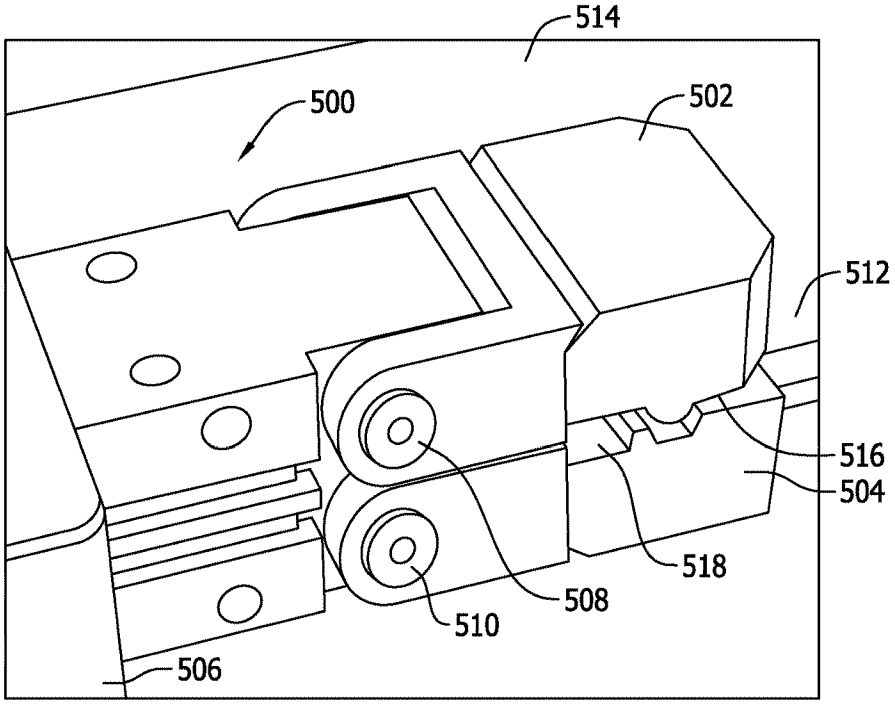
FIG. 5A is an exemplary gripper in a closed position.

Referring again to FIG. 4, the pair of grippers 301 may include a first gripper 302 and a second gripper 304 aligned along the axis of rotation 404 as illustrated in FIG. 4. In various aspects, any gripper device suitable for use in systems and methods of automated manufacturing of pressed metal parts may be incorporated into the apparatus 300 without limitation. FIG. 5A and FIG. 5B are perspective views of a gripper 500 in one aspect in a closed configuration (see FIG. 5A) and an opened configuration (see FIG. 5B). Referring again to FIG. 5A and FIG. 5B, each gripper 500 includes a first articulated appendage 502 and second articulated appendage 504 attached to a rotatable cylinder 506 using a first hinge joint 508 and a second hinge joint 510, respectively.

In various aspects, the gripper 500 may be operatively coupled to one or more actuators (not shown) to enable the movements of the first articulated appendage 502 and the second articulated appendage 504 between the opened and closed configurations. Any actuators suitable for generating the opening and closing forces used to open and close the gripper's articulated appendages 502/504 include, but are not limited to: pneumatic actuators, hydraulic actuators, and/or electromechanical actuators such as screwjacks.

In the closed position as illustrated in FIG. 5A, the gripper 500 may grasp or clamp an edge 512 of a sheet metal feedstock 514 between the first and second articulated appendages 502/504. In these various aspects, the first articulated appendage 502 and the second articulated appendage 504 may include first contact surface 516 and second contact surface 518, respectively. In one aspect, the first and second contact surfaces 516/518 may be coated with a compliant material including, but not limited to, a polymer such as nylon to inhibit slipping of the inner stamped part 102 when the gripper 500 is in a closed position, in particular while rotating the inner stamped part 102. In another aspect, the first and second contact surfaces 516/518 may be coated with a hard and/or wear-resistant material including, but not limited to, Kevlar, metal oxides, and/or metal carbides. In one aspect, the first and second contact surfaces 516/518 may be coated with Kevlar-impregnated nylon material to enhance the wear-resistance of the first and second contact surfaces 516/518.

In another additional aspect, illustrated in FIG. 5B, the first and second contact surfaces 516/518 may include interlocking surface features to inhibit slippage of the inner stamped part 102 within the gripper 500 during use. Any known interlocking surface features may be incorporated into the first and second contact surfaces 516/518 including, but not limited to: interlocking ridges and furrows, interlocking bumps and depressions, and any other known interlocking surface features. In one aspect, the first contact surface 516 may include a raised ridge 520 dimensioned to interlock within a corresponding furrow 522 formed within the second contact surface 518.

Referring again to FIG. 5A and FIG. 5B, the first articulated appendage 502 and the second articulated appendage 504 of the gripper 500 are operatively coupled to a rotatable cylinder 506 to form the first hinge joint 508 and the second hinge joint 510. In various aspects, the rotatable cylinder 506 is operatively coupled to an actuator (not illustrated) configured to rotate the gripper 500. In one aspect, the actuator rotates the inner part 102 as illustrated in FIG. 3 via the pair of grippers 301. In another aspect (not illustrated) the actuator may rotate the pair of grippers 101 after the inner stamped part 102 has been transferred to a subsequent station of the press line in order to reposition the pair of grippers 101 back to an initial position suitable for receiving the next inner stamped part 102 from the preceding station of the press line.

In various aspects, any one or more actuators suitable for generating the torque used to rotate each gripper 500 may be incorporated into the apparatus 300 including, but not limited to: pneumatic actuators, hydraulic actuators, and/or electromechanical actuators. In one aspect, each gripper 500 may be operatively coupled to a separate dedicated actuator, and the actuators associated with a pair of grippers 101 (see FIG. 4) are operated in a coordinated manner to rotate the inner stamped part 102. In another aspect, the first gripper 302 and second gripper 304 may be operatively coupled to a shared actuator to enable the coordinated movements of the pair of grippers 301.

By way of non-limiting example, the first gripper 302 and second gripper 304 may both be operatively coupled to a shared actuator 318, such as a rack and pinion rotary actuator 318, as illustrated in FIG. 4. Referring again to FIG. 4, the actuator 318 may be operatively coupled to a driveshaft 332. Each end of the driveshaft is retained in place by a first bearing 314 and a second bearing 316. One end of the driveshaft 332 is operatively coupled to the first gripper 302 via a first belt 328 and first series of pulleys 324. The opposite end of the driveshaft 332 is operatively coupled to the second gripper 304 via a second belt 330 and second series of pulleys 326.

In various aspects, the apparatus 300 is configured to rotate the inner stamped part 102 with respect to the outer stamped part 104 within any automated stamped metal production systems and devices without limitation. In one aspect, the apparatus may be positioned within a station of a press line of a stamped part manufacturing system. Non-limiting examples of stamped part manufacturing system suitable for use with the apparatus 300 include: tandem press systems, transfer press systems, and any other suitable stamped part manufacturing system known in the art.

Figure 10:
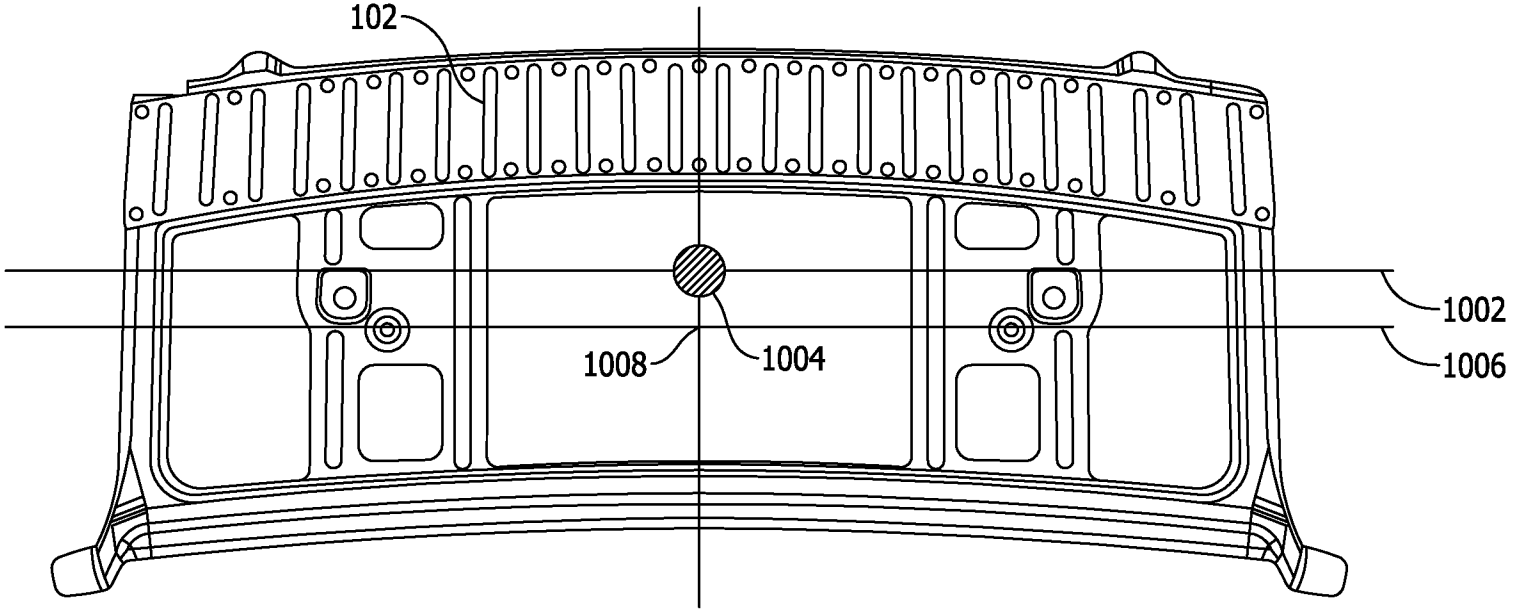
FIG. 10 is a top view of an inner stamped part showing two exemplary axes of rotation.

In various aspects, the apparatus 300 may further include at least one lifter configured to support the inner stamped part 102 as it is received from a preceding station in the press line, and as the rotated inner stamped part 102 is transferred to a subsequent station in the press line. The number of lifters included in the apparatus 300 may depend on any one or more of at least several factors including, but not limited to, the axis of rotation of the inner stamped part 102 as it is rotated by the apparatus 300. As illustrated in FIG. 10, if the selected axis of rotation 1002 passes through the center of gravity 1004 of the inner stamped part 102, the position of the center of gravity 1004 relative to the apparatus 300 does not vary before and after rotation of the inner stamped part 102. In this aspect, a single lifter may be used to support the inner stamped part 102 before and after rotation without risk of the inner stamped part 102 falling off of the single lifter.

In another aspect, also illustrated in FIG. 10, if the selected axis of rotation 1006 passes through the dimensional center 1008 of the inner stamped part 102, the position of the dimensional center 1008 relative to the apparatus 300 may be offset relative to the apparatus 300 if the dimensional center 1008 is offset from the center of gravity 1004 of the inner stamped part 102. In this aspect, a single lifter may be not be sufficient to support the inner stamped part 102 before and after rotation without risk of the inner stamped part 102 falling off of a single lifter due to the shift of the center of gravity 1004 due to rotation by the apparatus 300. In this other aspect, the apparatus may include a first lifter 306 and a second lifter 308 to support the inner stamped part 102 before and after rotation by the apparatus 300, respectively, as illustrated in FIG. 4.

Referring again to FIG. 4, the first lifter 306 and the second lifter 308 may be operatively coupled to a first piston 310 and a second piston 312, respectively, to raise and lower to support the inner stamped part 102 as needed during as the apparatus 300 is performing the method of rotating the inner stamped part 102 as described herein below. The first and second pistons 310/312 may each be coupled to a precision linear actuator configured to provide the necessary forces to move the lifters 306/308 between the raised and lowered positions. In various aspects, the apparatus 300 may further include a first piston guide 320 and a second piston guide 322 to define the respective paths travelled by the first and second lifters 306/308 between their respective raised and lowered positions.

Figure 7:
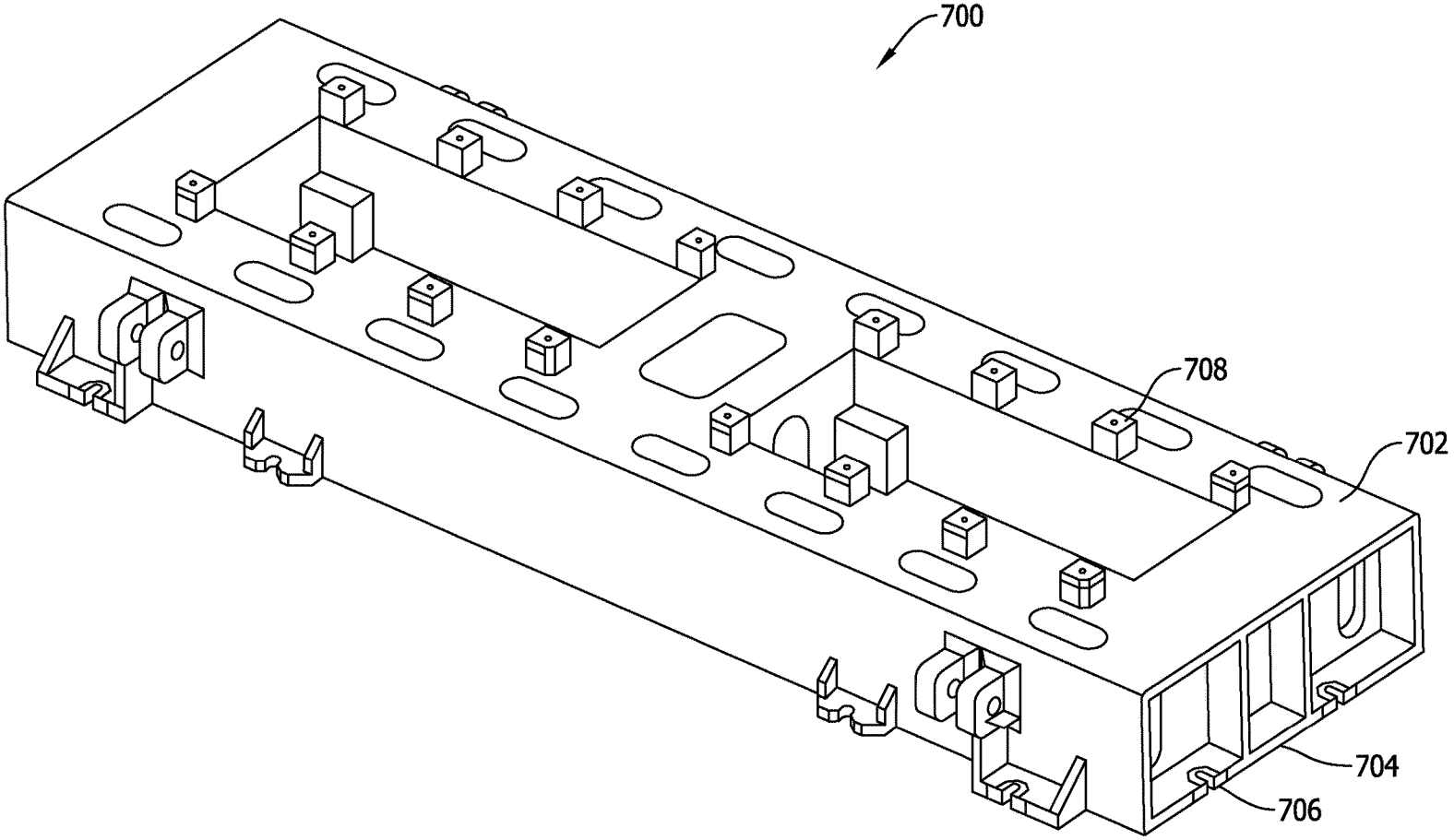
FIG. 7 is a perspective view of an exemplary base.

In one aspect, the apparatus 300 may further include a base configured to be affixed to a station of a press line, and further configured to be affixed to the apparatus. FIG. 7 is a perspective view of a base 700 in one aspect. As illustrated in FIG. 7, the base 700 may be a slab-like structure with an apparatus contact face 702 that is configured to be affixed to the apparatus 300 (not shown). In an aspect, the apparatus contact face 702 may be provided with a plurality of fastener fittings 708 configured to receive a plurality of corresponding fasteners to affix the apparatus 300 to the base 700. In another aspect, the base may further include a press contact face 704 situated opposite to the apparatus contact face 702. In this other aspect, the press contact face 704 may include a plurality of fastener fittings 706 configured to receive a plurality of corresponding fasteners to affix the base 700 to a station of a press line (not shown).

Figure 8:
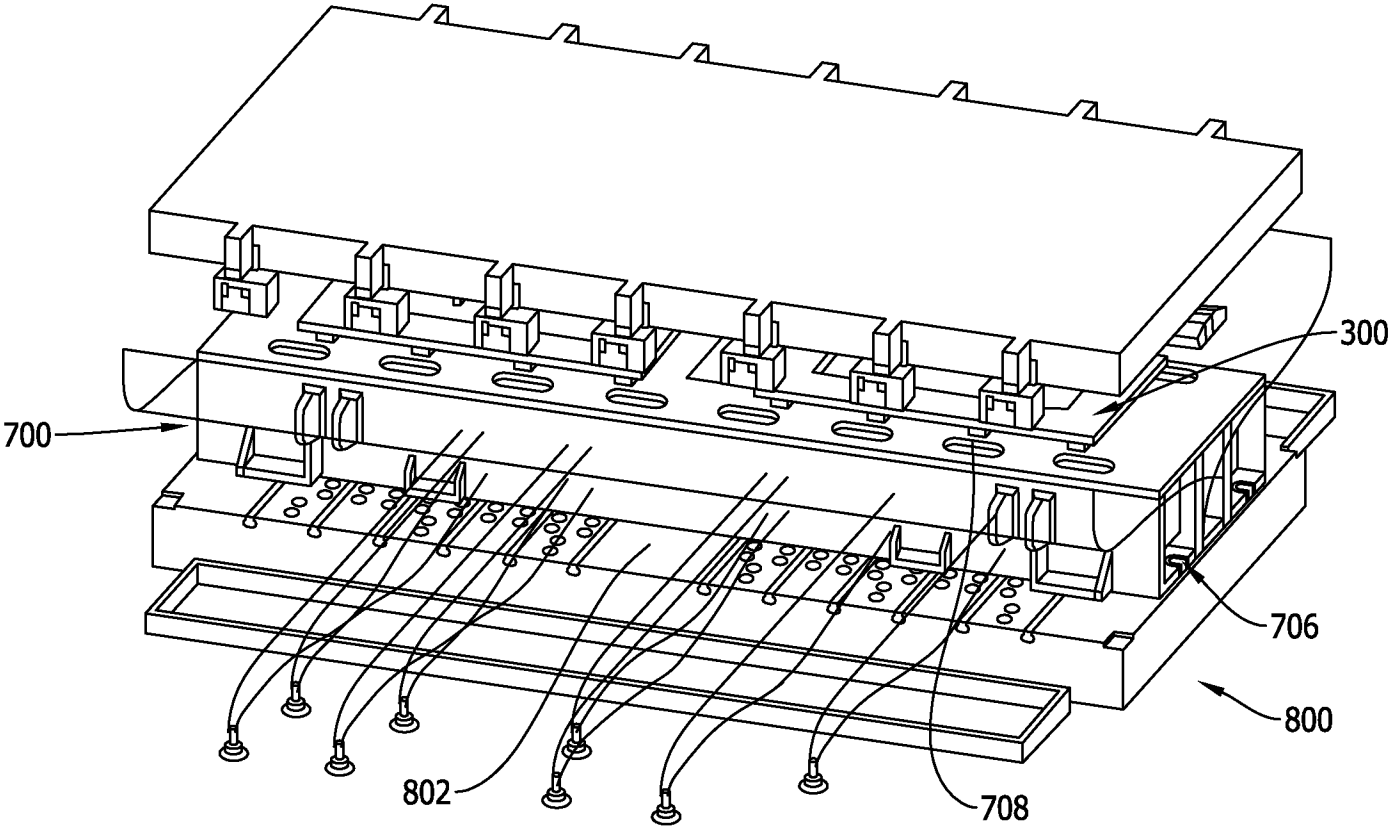
FIG. 8 is a perspective view of the base illustrated in FIG. 7 installed within an exemplary station of a press line.
Figure 9:
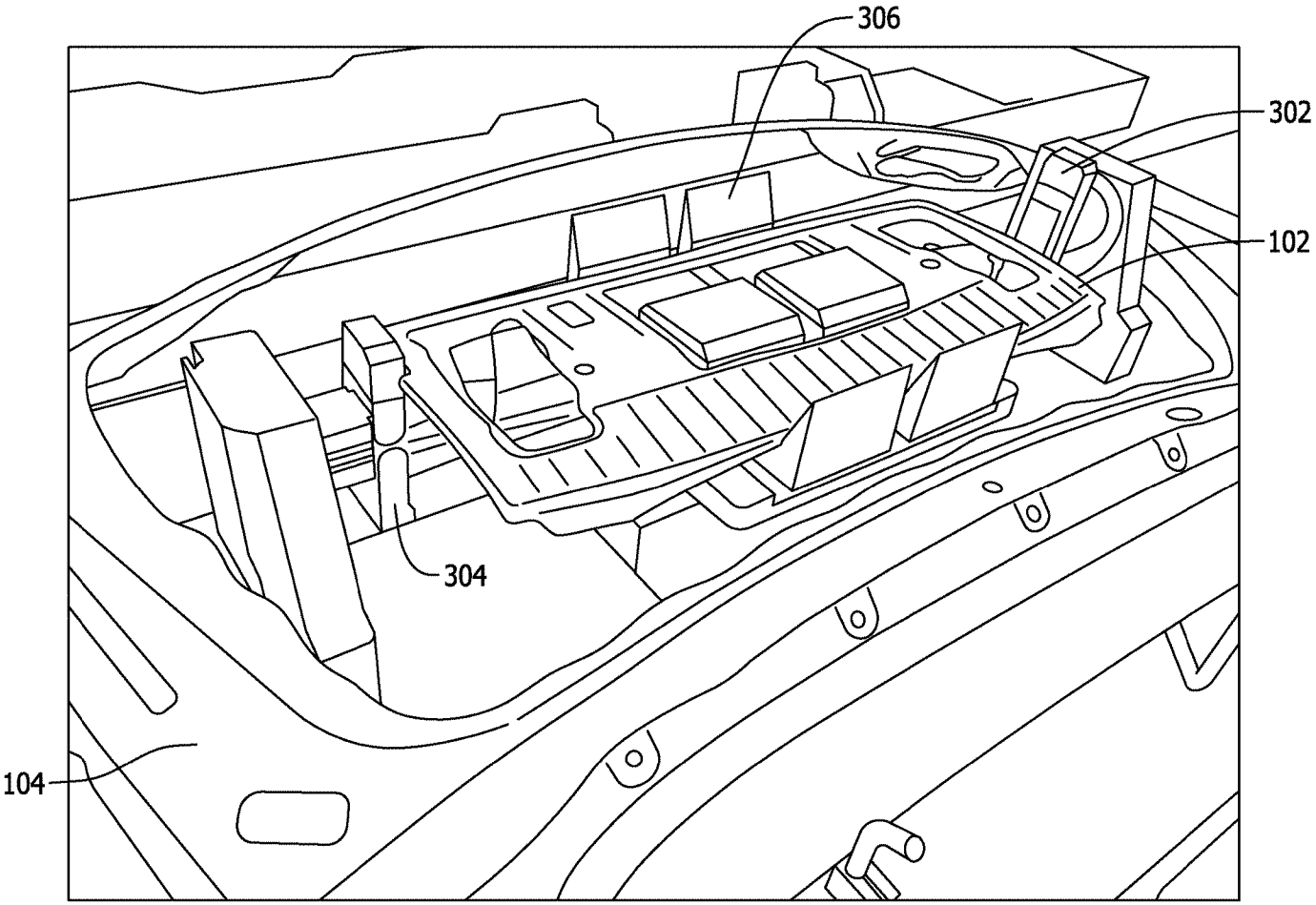
FIG. 9 is a perspective view of an inner stamped part nested within an aperture formed within an outer stamped part mounted on an exemplary apparatus.

FIG. 8 is a perspective view of the base 700 affixed to a station 802 of a press line 800. Referring to FIG. 8, fasteners are inserted through each fastener fitting 706 to affix the base 700 to the press line 800. Fasteners are also inserted into each fastener fitting 708 to affix the apparatus 300 to the base 700. In this perspective, the apparatus 300 and press line 800 together form a system for rotating the inner stamped part 102 relative to the outer stamped part 104.

In various aspects, the press contact face 704 may be customized to render the base 700 compatible with a particular press line. In these various aspects, a single design of an apparatus 300 may be rendered compatible with a wide variety of press lines by providing a variety of bases 700 with identical apparatus contact faces 702, in which each press contact face 704 of each base 700 corresponds to a different press line.

Figure 6A:
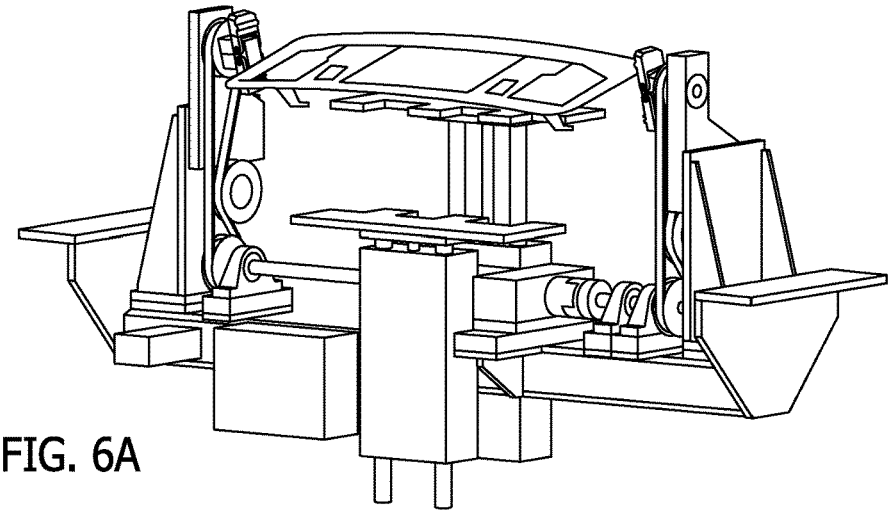
FIG. 6A is a perspective view of an apparatus for use in rotating an inner stamped part relative to an outer stamped part in which the inner stamped part is supported by a lifter and the gripper jaws are opened to receive the inner stamped part.
Figure 6B:
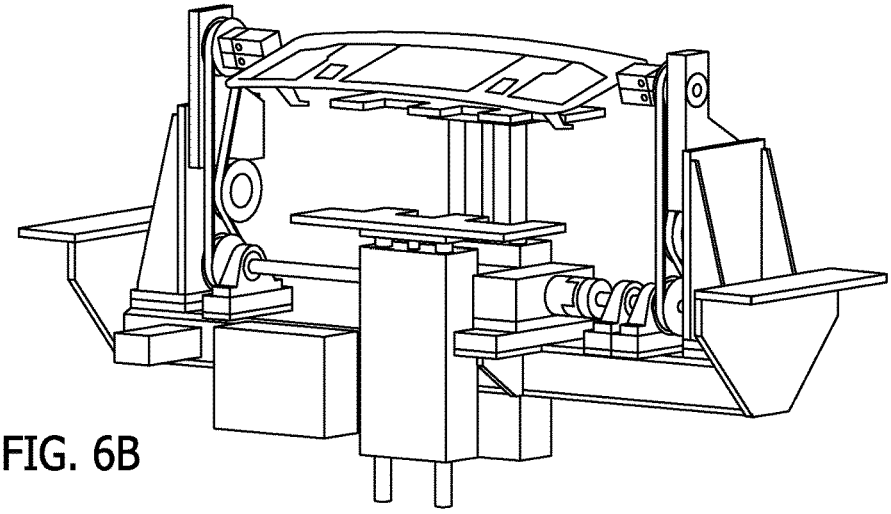
FIG. 6B is a perspective view of the apparatus illustrated in FIG. 6A in which the gripper jaws have been closed to grip the inner stamped part.
Figure 6C:
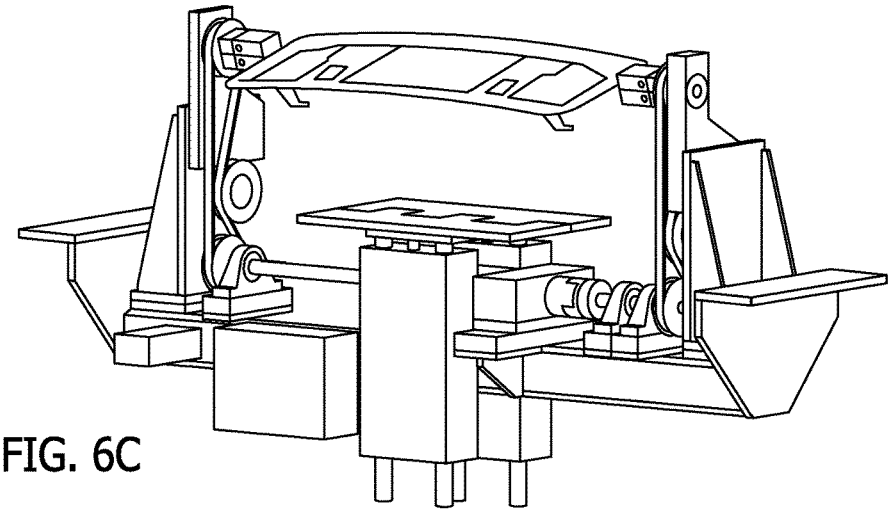
FIG. 6C is a perspective view of the apparatus illustrated in FIG. 6B in which the lifter has been lowered.
Figure 6D:
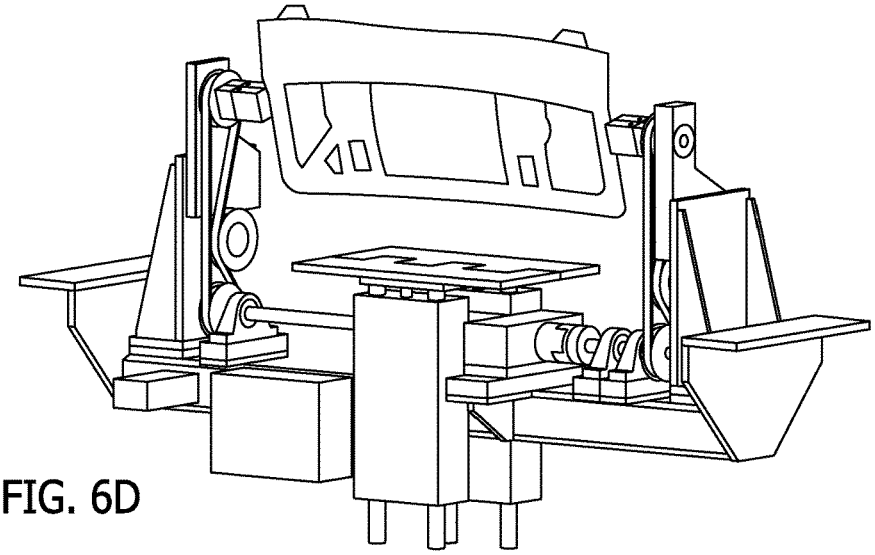
FIG. 6D is a perspective view of the apparatus illustrated in FIG. 6C in which the inner stamped part is partially rotated.
Figure 6E:
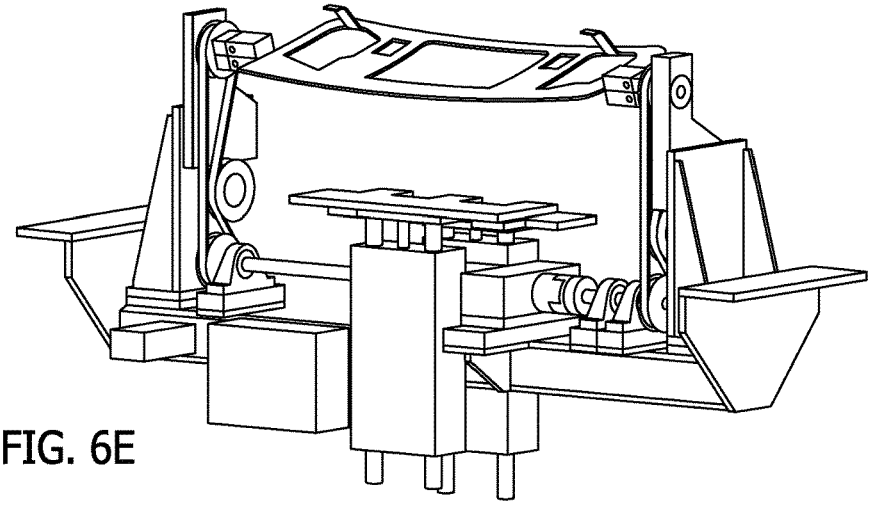
FIG. 6E is a perspective view of the apparatus illustrated in FIG. 6D in which the inner stamped part is fully rotated.
Figure 6F:
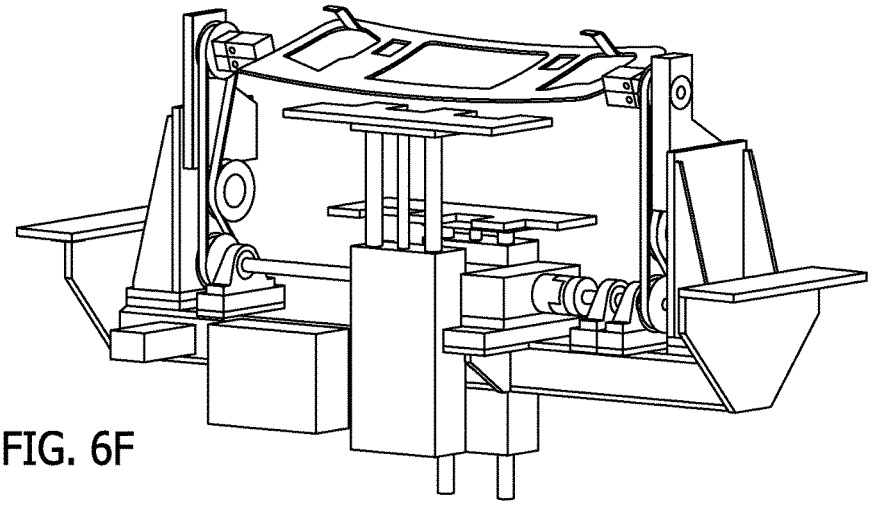
FIG. 6F is a perspective view of the apparatus illustrated in FIG. 6E in which a second lifter is raised to support the inner stamped part.
Figure 6G:
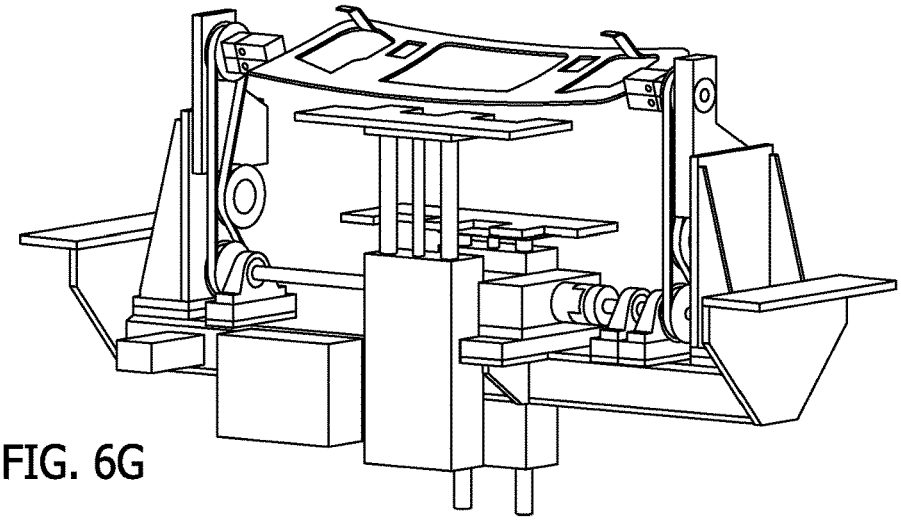
FIG. 6G is a perspective view of the apparatus illustrated in FIG. 6F in which the gripper jaws are opened to release the inner stamped part.
Figure 6H:
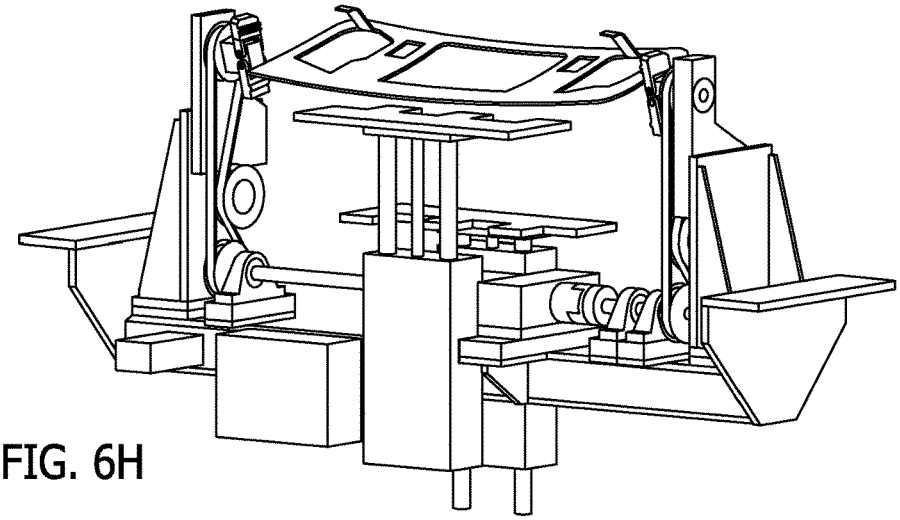
FIG. 6H is a perspective view of the apparatus illustrated in FIG. 6G in which the gripper jaws are rotating to the initial rotation illustrated in FIG. 6A.
Figure 6I:
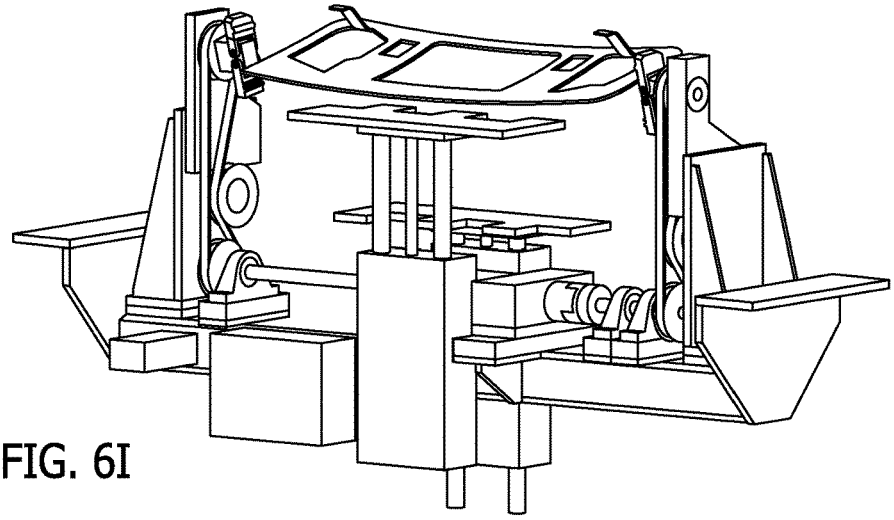
FIG. 6I is a perspective view of the apparatus illustrated in FIG. 6H in which the gripper jaws have rotated back to the initial rotation illustrated in FIG. 6A.

In various aspects, the apparatus 300 may be used to perform a method of rotating the inner stamped part relative to the outer stamped part within a press line used to produce the stamped parts 102/104. FIGS. 6A-6I illustrated the arrangement of the apparatus and inner stamped part at various steps of the method. Referring to FIG. 6A, the gripper jaws are configured to an open position and the first lifter is configured to a raised position to receive and support the inner stamped from a previous station from the press line. As illustrated in FIG. 6B, the gripper jaws are then configured to a closed position to grip the inner stamped part. The first lifter is then lowered to provide a clear path within which the inner stamped part may be rotated. The pair of grippers of the apparatus is then rotated, causing the corresponding rotation of the inner stamped part, as illustrated in FIG. 6D. Upon completion of the rotation of the inner stamped part (see FIG. 6E), the second lifter is configured in a raised position to support the inner stamped part when the jaws of the grippers are opened, as illustrated in FIG. 6G. Once the gripper jaws are opened, the rotated inner stamped party may then be removed and/or transferred to a subsequent station of the press line. Referring to FIG. 6H, the opened gripped jaws may then be rotated back to their initial starting position, shown illustrated in FIG. 6I. The second lifter may then be lowered and the first lifter raised to prepare the apparatus for receiving another inner stamped part from the previous station of the press line.

Figure 11:
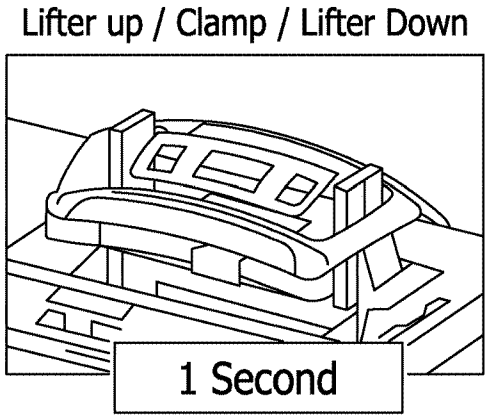
FIG. 11 is a schematic illustration of a first phase of performing an exemplary method of rotating an inner stamped part relative to an outer stamped part.
Figure 12:
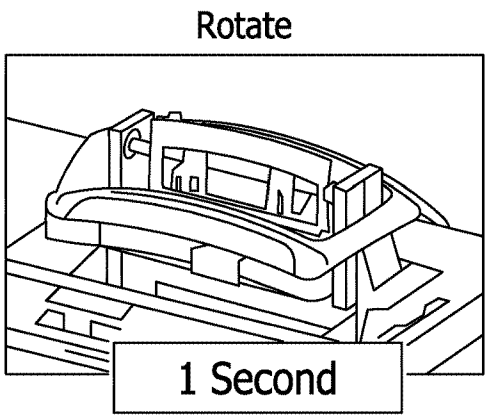
FIG. 12 is a schematic illustration of a second phase of performing the method illustrated in FIG. 11.
Figure 13:
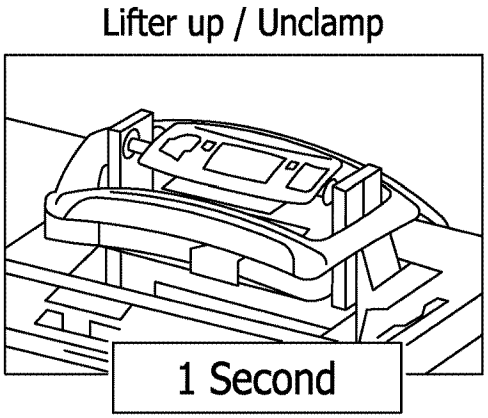
FIG. 13 is a schematic illustration of the third phase of performing the method illustrated in FIG. 11.

In various aspects, in order to enhance the compatibility of the apparatus with the press line, the elapsed time taken to rotate the inner stamped part may be configured to fit within a characteristic cycle time of the press line. In various aspects, this cycle time typically varies from about 2 seconds to about 10 seconds. By way of non-limiting example, the apparatus may perform all steps of the method of rotating the inner stamped part within 3-second cycle time representative of a cycle time of a press line. As illustrated in FIGS. 11-13, the inner stamped part may be received and gripped in the first second (see FIG. 11), rotated in the next second (see FIG. 12), and released to the next station of the press line in the third second.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An apparatus for rotating an inner stamped part with respect to an outer stamped part, the inner stamped part nested within an aperture formed within the outer stamped part such that a gap is defined between the inner stamped part and the outer stamped part, said apparatus comprising:

a plurality of grippers comprising at least a first gripper positioned at a first edge of the inner stamped part, and a second gripper positioned at a second edge of the inner stamped part opposite to the first edge, wherein said plurality of grippers are positioned within the aperture of the outer stamped part and above the inner stamped part; and a lifter configured to raise the inner stamped part to be received at said plurality of grippers, wherein said plurality of grippers are configured to:

grip the inner stamped part at the first edge and the second edge, respectively;

rotate the gripped inner stamped part about an axis of rotation, wherein the axis of rotation intersects said first gripper and said second gripper; and open to release the inner stamped part, wherein said lifter is further configured to lower the inner stamped part from said plurality of grippers after release of the inner stamped part.

2. The apparatus of claim 1, wherein the axis of rotation intersects a center of gravity of the inner stamped part.

3. The apparatus of claim 1, wherein the axis of rotation intersects a dimensional center of the inner stamped part.

4. The apparatus of claim 3, wherein the lifter comprises:

a first lifter configured to raise the inner stamped part to said plurality of grippers to receive and grip the inner stamped part; and a second lifter configured to lower the inner stamped part from said plurality of grippers after release of the inner stamped part.

5. The apparatus of claim 1, further comprising a base affixed to said plurality of grippers and affixed to a station of a press line.

6. A system for rotating an inner stamped part with respect to an outer stamped part, the inner stamped part nested within an aperture formed within the outer stamped part such that a gap is defined between the inner stamped part and the outer stamped part, the system comprising:

a plurality of grippers comprising at least a first gripper positioned at a first edge of the inner stamped part, and a second gripper positioned at a second edge of the inner stamped part opposite to the first edge;

a base affixed to said plurality of grippers and further affixed to a station of a press line; and a lifter configured to raise the inner stamped part to be received at said plurality of grippers and lower the inner stamped part from said plurality of grippers after rotation of the inner stamped part.

7. The system of claim 6, wherein said plurality of grippers is configured to:

grip the inner stamped part at the first edge and second edge, respectively;

rotate the gripped inner stamped part about an axis of rotation, wherein the axis of rotation intersects the first gripper and the second gripper; and open to release the inner stamped part.

8. The system of claim 6, wherein said plurality of grippers is positioned within the aperture of the outer stamped part and above the inner stamped part.

9. The system of claim 6, wherein the axis of rotation intersects a center of gravity of the inner stamped part.

10. The system of claim 6, wherein the axis of rotation intersects a dimensional center of the inner stamped part.

11. The system of claim 10, wherein the lifter comprises:

a first lifter configured to raise the inner stamped part to said plurality of grippers to receive and grip the inner stamped part; and a second lifter configured to lower the inner stamped part from said plurality of grippers after release of the inner stamped part.

12. A method for rotating an inner stamped part with respect to an outer stamped part, the inner stamped part nested within an aperture formed within the outer stamped part, the method comprising:

receiving the inner stamped part onto a lifter, the inner stamped part positioned for gripping by at least a first gripper in an opened position and a second gripper in the opened position;

raising the inner stamped part with the lifter to a raised position such that the inner stamped part is received at the first gripper and the second gripper;

closing the first and second grippers to grip the inner stamped part;

lowering the lifter away from the gripped inner stamped part;

rotating the inner stamped part about an axis of rotation intersecting the first gripper and the second gripper;

raising the lifter up to the rotated inner stamped part; and opening the first and second grippers to release the rotated inner stamped part.

13. The method of claim 12, wherein receiving the inner stamped part further comprises receiving the inner stamped part from a preceding station of a press line.

14. The method of claim 12, wherein the method further comprises transferring the outer stamped part and the rotated inner stamped part to a subsequent station of a press line.

15. The method of claim 12, wherein rotating the inner stamped part about an axis of rotation further comprises rotating the inner stamped part about an axis of rotation that intersects a center of gravity of the inner stamped part.

16. The method of claim 12, wherein rotating the inner stamped part about an axis of rotation further comprises rotating the inner stamped part about an axis of rotation that intersects a dimensional center of the inner stamped part.

17. The method of claim 16, wherein the lifter includes a first lifter and a second lifter, wherein receiving the inner stamped part further comprises receiving the inner stamped part onto the first lifter in the raised position so that the first lifter is positioned directly below the inner stamped part; and wherein raising the lifter up further comprises raising the second lifter up to the rotated inner stamped part prior to opening the first and second grippers, wherein the second lifter is positioned directly below the rotated inner stamped part.

* * * * *